US006098218A

United States Patent [19]

Ventura

[11] Patent Number: 6,098,218

[45] Date of Patent: Aug. 8, 2000

[54] CABIN COT

[76] Inventor: Scott E. Ventura, R.R. #4, Box 69A Lower Kula Rd., Kula, Hi. 96790

[21] Appl. No.: 09/099,134

[22] Filed: Jun. 18, 1998

[51] Int. Cl.[7] ..... A47C 29/00; A47C 17/64

[52] U.S. Cl. ..... 5/113; 135/96; 135/91

[58] Field of Search ..... 5/113, 111, 414, 5/114; 135/96, 91

[56] References Cited

U.S. PATENT DOCUMENTS

| | | | |
|---|---|---|---|
| 2,508,254 | 5/1950 | Ham | 5/113 |
| 2,611,906 | 9/1952 | Backer | 5/114 |
| 2,611,908 | 9/1952 | Siggers | 5/114 |
| 2,841,803 | 7/1958 | Bolding | 5/113 |
| 5,555,576 | 9/1996 | Kim | 5/114 |

*Primary Examiner*—Alexander Grosz

*Attorney, Agent, or Firm*—Rodger H. Flagg

[57] ABSTRACT

A cabin cot includes a canopy, a base sheet, and legs. The base sheet forms a bed portion, and the canopy includes window mosquito netting portions. A plurality of legs support the cabin cot. A pair of ribs having stop portions are assembled in end frame members, and the end frame members are connected to side members for supporting the base sheet. The ribs are formed as rods of flexible material, so that they can be stored or carried as a generally straight piece, and can be manually bent or flexed into position in the end frame member 40 when assembly is performed. The resiliency of the ribs serves to provide a retaining force which retains each rib in position in retaining apertures in the respective end frame member. The retaining apertures can be disposed at varying angles, and the angle of the retaining apertures determines the amount of force retaining the ribs to the end frame members.

20 Claims, 5 Drawing Sheets

CABIN COT

FIELD OF THE INVENTION

The present invention relates to portable enclosures suitable for use with or attachment to, a bed, cot, or other structure having a perimeter frame. More particularly, the invention relates to a cabin cot having a covered sleeping area protected from pests and providing shelter.

BACKGROUND OF THE INVENTION

In general, beds, cots, tents, and protective coverings are known in the art. Coverings for cots and beds are referred to herein as enclosures. Such enclosures are used, for example, to provide shelter against the elements for outdoors camping, and to provide protection against pests such as insects.

In U.S. Pat. No. 659,981, issued Oct. 16, 1900, a pair of generally semi-circular ribs are used to support an enclosure having front and rear flaps.

According to U.S. Pat. No. 709,528, issued Sep. 23, 1902, a mosquito canopy is shown having mosquito netting supported by a frame formed by rib members and a connector which attached the rib members at a summit of the canopy.

U.S. Pat. No. 1,414,616, issued May 2, 1992, teaches a canopy formed of mosquito netting and rib members. A connector attached the rib members at an apex of the canopy.

Likewise, U.S. Pat. No. 452,971, issued May 26, 1891, teaches a canopy formed of mosquito netting and rib members. A rigid base is provided, and the rib members are foldable onto the rigid base.

U.S. Pat. No. 46,195, issued Jan. 31, 1865, teaches a cot having a canopy formed of a covering and semi-circular rib members supporting the covering. A rigid base is provided, and the rib members are foldable onto the rigid base.

U.S. Pat. No. 1,751,290, issued Mar. 18, 1930, teaches a canopy formed of mosquito netting and foldable rib members. Connectors attached the rib members support them in a locked configuration when the canopy is unfolded.

U.S. Pat. No. 2,508,254, issued May 16, 1950, teaches a canopy formed of a covering having mosquito netting and rib members. A rigid base is formed by frame members which are pinned together to form a folding arrangement. Two semi-circular frame members (11, 12 in FIG. 3 of this patent) are formed of metal and are flexible. They are retained vertically by an upright frame member (part number 10 in this patent) and are pinned thereto. Keeper members (13) are provided in side bars (2, 3) to retain the ends of the two semi-circular frame members (11, 12).

U.S. Pat. No. 3,619,827, issued Jul. 30, 1985, teaches a foldable cot, having an enclosure which is supported by cables (86, 87 in FIG. 2 of this patent).

U.S. Pat. No. 4,531,330, issued Jul. 30, 1985, teaches a shelter unit having an air mattress and lightweight tent. The tent is supported by inflatable arches.

U.S. Pat. No. 4,590,956, issued May 27, 1986, teaches a mosquito canopy having mosquito netting supported by a frame formed by rib members. A connector attaches the rib members to a base.

U.S. Pat. No. 5,449,014, issued Sep. 12, 1995, teaches a collapsible shelter having rib members and a canopy supported by the rib members. The rib members are supported by a rigid frame, and are pivotally connected to the rigid frame for folding.

U.S. Pat. No. 5,489,052 issued Feb. 6, 1996, is directed to a backpack frame which is convertible to a tent supporting frame formed by rib members rigidly connected to a base. A covering is supported by the frame.

U.S. Pat. No. 5,494,066, issued Feb. 27, 1996, is directed to an insect proof bridle tethered enclosure for beds or cots. Ribs are rigidly connected to formed a support for a canopy, and the ribs themselves are supported to hang from an overhead cable.

The connections of the rib members and bed frame members in the prior art are relatively complex, requiring complex assembly and/or complex manufacture, reducing ease of use and also adding to their cost of manufacture. It is a problem in the art to provide a relatively simple, easy to assemble enclosed cot, that is relatively low in cost and relatively easy to manufacture.

It is also a problem in the art to provide a provide a relatively sturdy, yet easy to assemble enclosed cot.

It is additionally a problem in the art to provide a provide a relatively sturdy, yet easy to assemble enclosed cot, which employs flexible rib members so that the ribs can be organized in a compact arrangement which disassembled.

SUMMARY OF THE INVENTION

From the foregoing, it is seen that it is a problem in the art to provide a cabin cot meeting the above requirements. According to the present invention, a cabin cot is provided which meets the aforementioned requirements and needs in the prior art. Specifically, the device according to the present invention employs flexible rib members, a base formed by left and right side frame members 50 and elongated end frame members, and a flexible canopy supported by the rib members.

An object of the present invention is to provide a relatively sturdy, yet easy to assemble enclosed cot.

Another object of the present invention is to provide a relatively simple, easy to assemble enclosed cot, that is relatively low in cost and relatively easy to manufacture.

It is a further object of the present invention to provide relatively sturdy, easy to assemble enclosed cot, which employs flexible rib members so that the ribs can be organized in a compact arrangement which disassembled.

These and other objects according to the present invention are accomplished by provision of a cabin cot having extended end frame members. The present invention further includes a canopy, a base sheet, and legs. The base sheet forms a bed portion, and the canopy includes window mosquito netting portions. A plurality of legs support the cabin cot. A pair of ribs having stop portions are assembled in the extended end frame members, and the extended end frame members are connected to side members for supporting the base sheet. The ribs are formed as rods of flexible material, so that they can be stored or carried as a generally straight piece, and can be manually bent or flexed into position in the end frame member 40 when assembly is performed. The resiliency of the ribs serves to provide a retaining force which retains each rib in position in retaining apertures in the respective elongated end frame member. The retaining apertures can be disposed at varying angles, and the angle of the retaining apertures determines the amount of force retaining the ribs to the elongated end frame members.

Other objects and advantages of the present invention will be more readily apparent from the following detailed description when read in conjunction with the accompanying drawings.

DETAILED DESCRIPTION OF THE INVENTION

Figure 1:
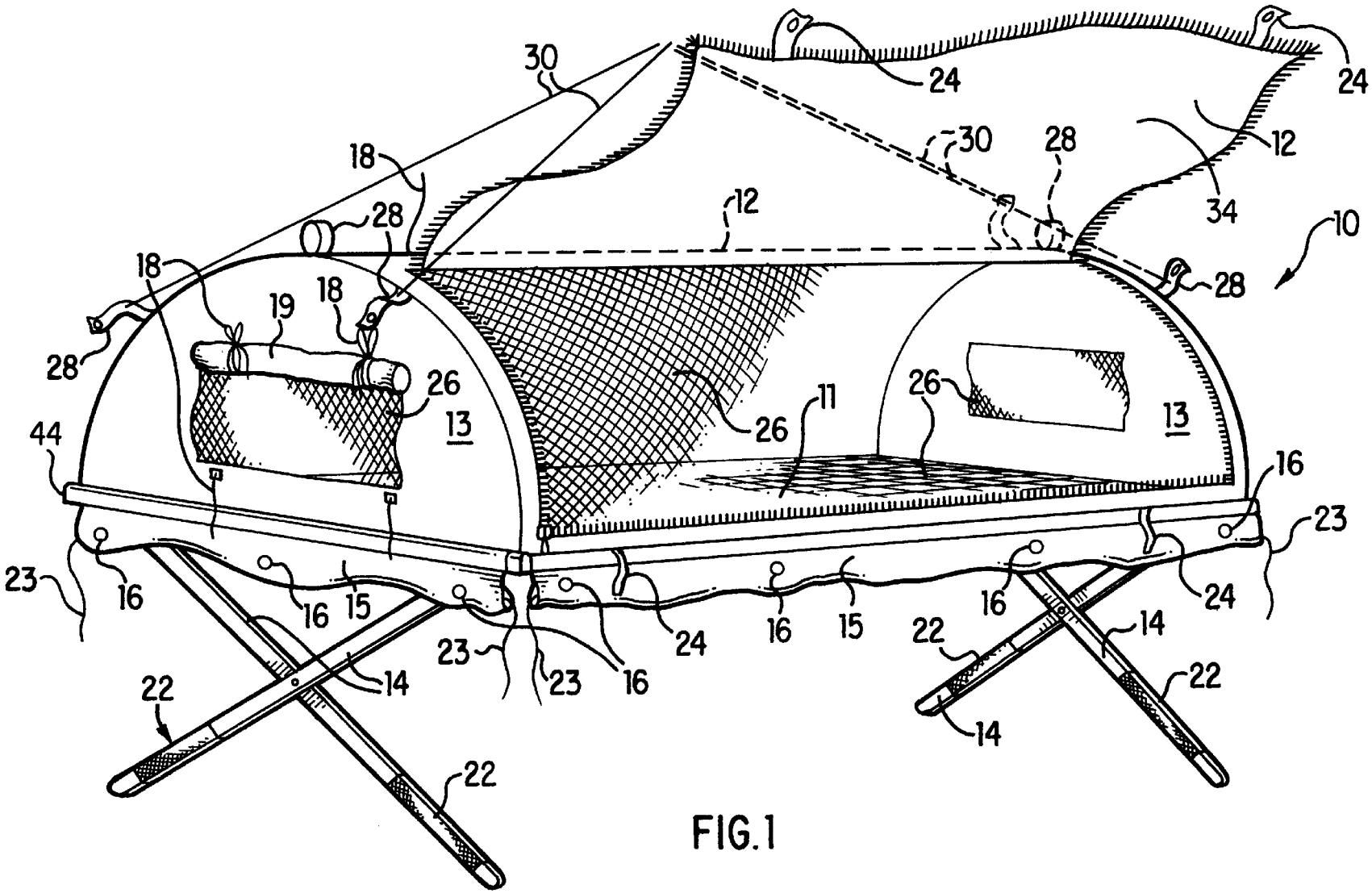
FIG. 1 is a perspective view of a cabin cot according to the present invention with crossed legs and overhead supporting lines.

A cabin cot 10 shown in FIG. 1 includes a canopy 12, base sheet 11, and legs 14. The base sheet 11 forms a bed portion. The canopy 12 includes window mosquito netting portions 26, and tie flap straps 18 for retaining a flexible cover portion 19 in a rolled-up configuration when the window mosquito netting portions 26 are to be in an opened condition. End panels 13 are provided as part of the canopy 12.

Figure 7:
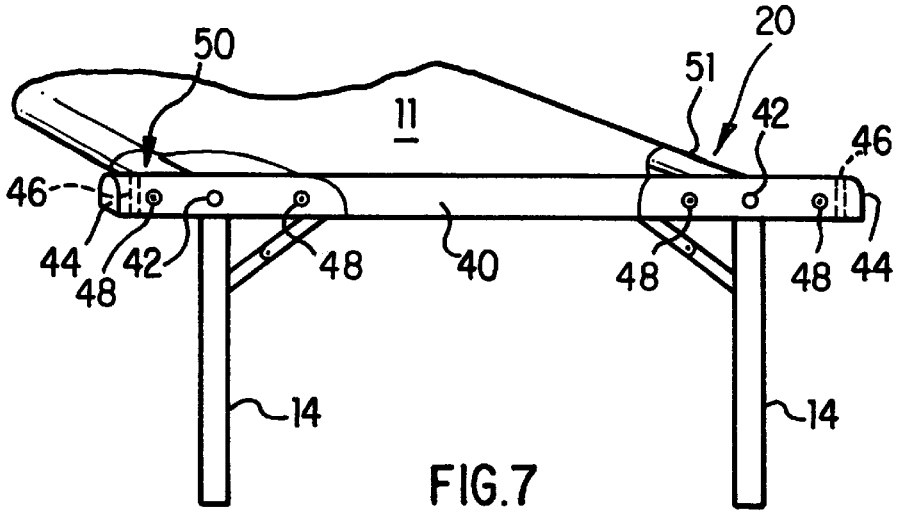
FIG. 7 is a perspective view of the assembled side frame members and end member of FIG. 6 with partial legs.

A plurality of legs 14 support the cabin cot 10. The legs 14 may extend from either the left and right side rails or from the first and second end rails, to suit manufacturing preference. Four to six legs 14 may be used, without departing from the scope of this disclosure, or from the following claims. The legs 14 may be crossed, as shown in FIG. 1, or they may extend straight down, as shown in FIG. 7. The legs preferably have bug stoppers 22, which may be formed of any material avoided by insects, or the legs 14 can be treated with an insecticide. The bug stoppers 22 are optional, and can be omitted entirely without departing from the scope of the present invention.

The legs 14, frame means 20, canopy 12, and base sheet 11 are exemplary, and form the preferred embodiment. Additionally, other embodiments are also contemplated as being within the scope of the present invention. For example, more than four legs 14 can be employed, or replaced by a solid base, a hollow frame, or a panel frame. Also, the legs 14 typically are pinned together (pins not shown) at their crossing points, but this is not necessary and other support arrangements can be used. Also, the base sheet 11 can be replaced by a mattress, solid flat base, bed, or pad. Additionally, the canopy 12 can be formed of any covering, including mosquito netting, canvas, fabric, or combination of such materials, and can be transparent, opaque, or a combination of transparent and opaque materials.

As seen in FIG. 1, the canopy preferably has overhang portions 15 which extend six to eight inches below the level of the base sheet 11, and have a plurality of grommets 16 in spaced relation therethrough. The grommets 16 form a securing means, and can be replaced with glue, adhesive, hook-and-loop fasteners, ultrasonic welding, etc. to suit manufacturing or design preference. Suitable cords 23, such as nylon cords, are shown in FIG. 1, and are respectively sewn into hems formed in the overhang portions 15. The cords 23 provide a means to easily secure the canopy beneath the frame portion during use. Other means of securement may also be used without departing from the scope of this disclosure, or from the following claims. Tie straps 24 may also be provided for securing the canopy 12 to the side frame members.

At least a portion of the top canopy portion 12 may be made of a suitable musquito netting material 26, and a flexible canopy cover 34 may be sized to cover the musquito netting material 26 when the canopy cover 34 is rolled down. Alternately, the flexible canopy cover 34 may be rolled up and secured with tie straps 28 to expose the musquito netting material 26 for improved ventilation. The flexible canopy cover 34 is shown in an opened position in FIG. 1 and in closed position in FIG. 2.

Figure 2:
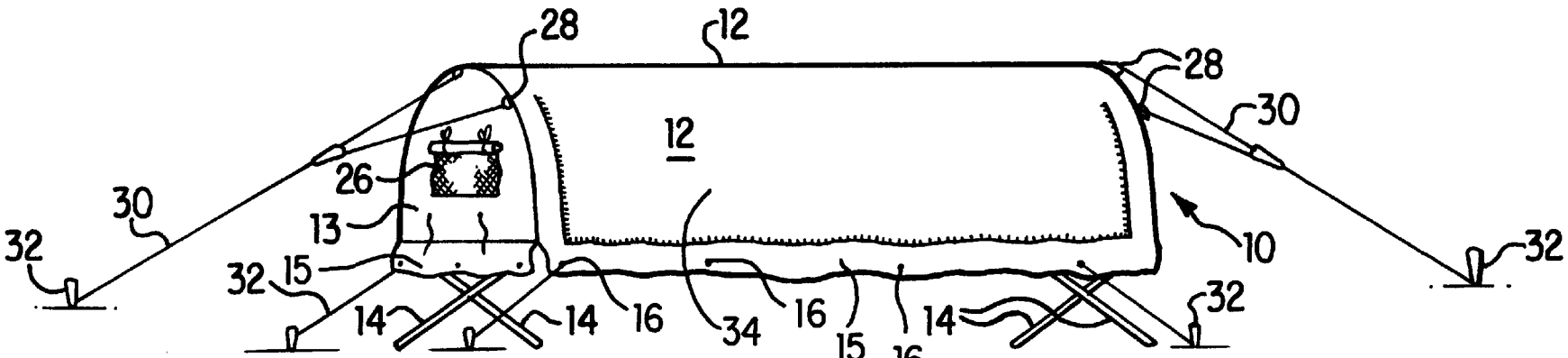
FIG. 2 is a side, view of the cabin cot of FIG. 1 with ground supporting lines.

Tie straps 28 are provided in spaced relation along the first and second canopy end portions 13 adjacent to the top canopy 12, as shown in FIG. 1. Tie lines 30 may be used to anchor the cabin cot 10 to the ground using stakes 32, as shown in FIG. 2. Alternately, tie lines 30 may be used to support the canopy 12 from a remote location above the canopy 12, as shown in FIG. 1. This embodiment is exemplary, and the tie lines 30 may be omitted where the flexible ribs 60 are sufficient to support the canopy 12. The entire canopy 12 can be suspended by a suitable tie line, for example, where a tree branch or overhead beam member is available for support, without departing from the scope of the present invention.

Figure 3:
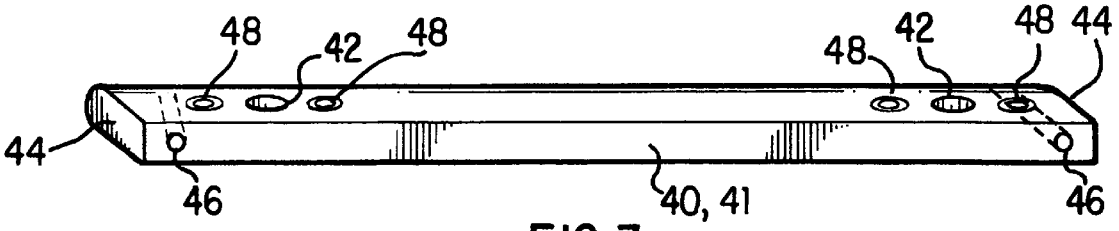
FIG. 3 is a bottom view of an end frame member according to the present invention.
Figure 4:
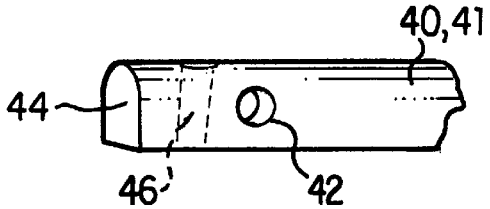
FIG. 4 is a partial side view of the end frame member of FIG. 3.
Figure 5:
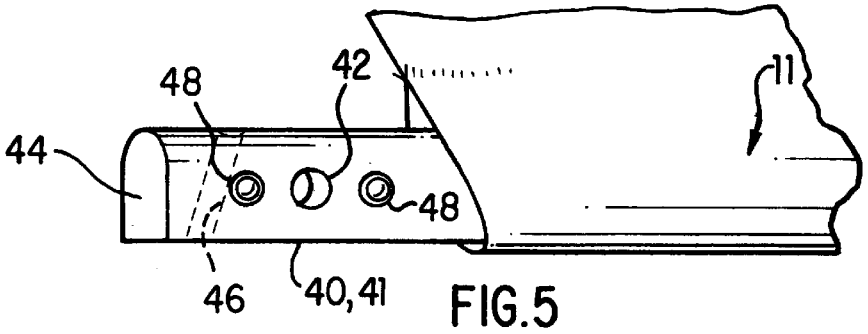
FIG. 5 is a perspective view of the edge and top of the end frame member of FIG. 4 with a base sheet member attached.

An elongated end frame member 40 is shown in FIG. 3 through FIG. 5 for use in the present invention. The elongated end frame member 40 is shown in perspective view in FIG. 3, such that its bottom end is facing forward. As seen in FIG. 3, the elongated end frame member 40 has a pair of spaced apertures 42 to facilitate assembly with a shaft portion 52 extending from the distal ends 58 of the left and right side frame members 50, shown in FIG. 6. In this embodiment, no tools are needed for assembly of the cabin cot apparatus 10.

Figure 9:
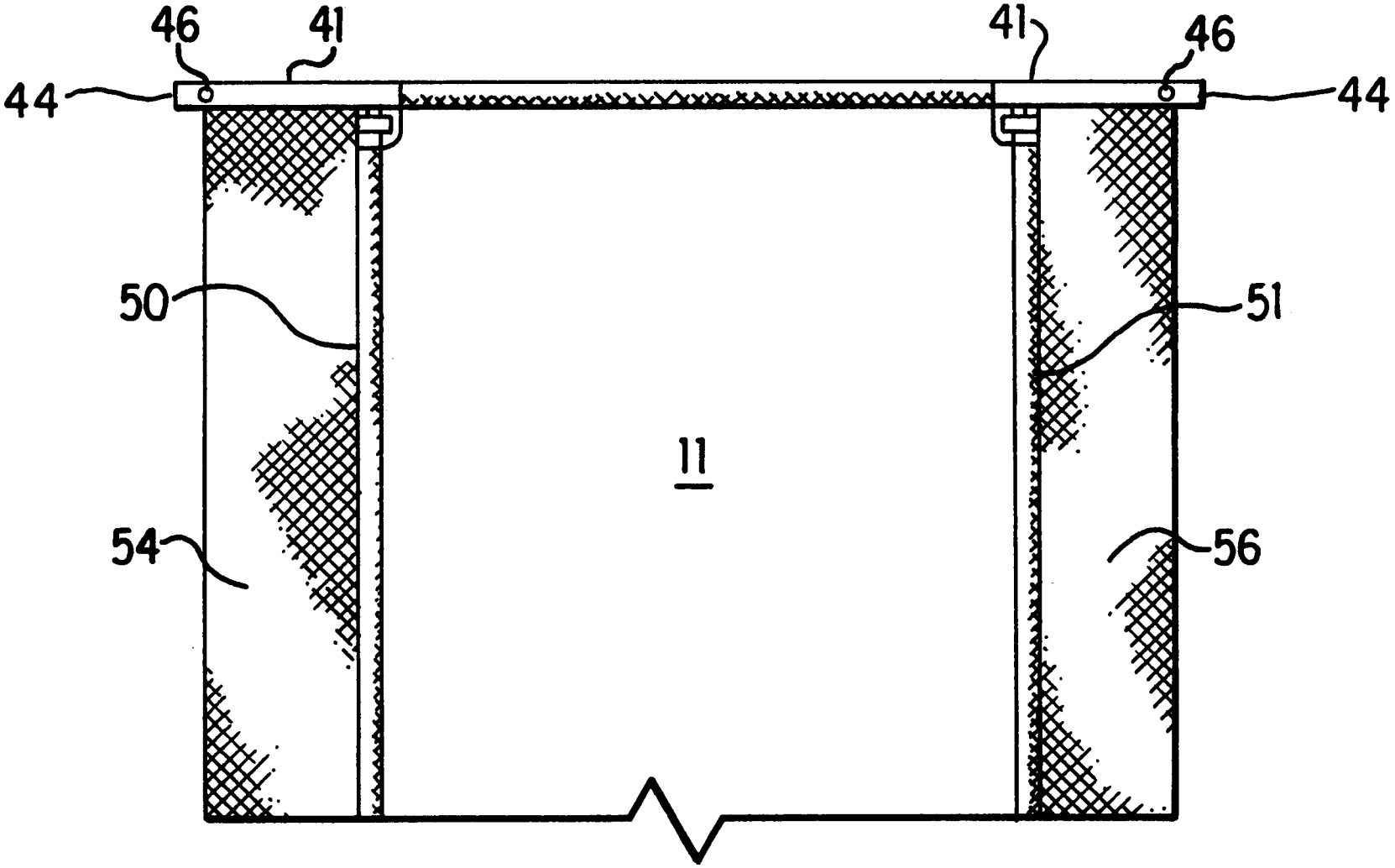
FIG. 9 is a top view of the cot and frame assembly showing additional air flow extending along the side frame rails, with mosquito netting covering the air flow area.

As shown in FIG. 9, the distal ends 44 of the elongated end frame members 40 extend from three to twelve inches beyond the left and right side frame rails 50, to provide space between the sides of the canopy 12 and the base sheet 11. The space provided between the side frame rails 50 and the sides of the canopy 12 allows for the passage of air into the cabin cot 10 from below, which is extremely beneficial in tropical climates. The space provided between the side frame rails 50 and the sides 15 of the canopy 12 further isolate the bedding from the canopy sides 15, eliminating the problem of moisture on the inside of the canopy from wetting the bedding during use.

Preferably, the canopy sides 15 are sized to extend to the side frame rails 50 beneath the netting material 54 between the side frame rails 50 and the canopy 12 sides 15, in cold weather. The additional space provided between the side frame rails 50 and the canopy 12 sides 15, further serves to provide additional space to the user within the cabin cot 10 enclosure. The elongated end frame members 40 may be retrofitted to existing cot frames, to provide the novel features of this invention, or they may be supplied as part of the original cot frame.

The end frame apertures 42 are part of an attaching means for attaching the end frame member 40 to the side frame members 50, and can be replaced with other attaching means such as nut-and-bolt fasteners, pins, and other means of attachment without departing from the scope of the present invention.

The elongated end frame member 40 has a rib retaining aperture 46, which is a substantially vertically aligned aperture 46 formed near the distal ends 44 of the elongated end frame member 40. The rib retaining aperture 46 may be inclined up to fifteen degrees from vertical to provide additional tension on the flexible rib 60 as it is inserted into the rib retaining apertures 46. FIG. 4 shows the retaining aperture 46 inclined in side view in dotted outline. While the rib retaining aperture 46 is shown as having a circular cross section, other cross sections can also be used, such as triangular, square, hexagonal, and the like, without departing from the scope of the present invention.

Also, although the rib retaining aperture 46 is shown as extending at an angle up to 15 degrees from vertical toward the right as seen in FIG. 4, it can also be adapted to extend vertically (e.g. "square" or at right angles to the top and bottom surfaces of the end frame member 40), or the rib retaining aperture 46 may alternately extend at an angle up to 15 degrees toward the left or right from the vertical. All such variations and embodiments are contemplated as being within the scope of the present invention.

The attachment of the base sheet 11 to the end frame member 40 is shown in FIG. 5. Attachment may comprise an open end loop into which the elongated end frame member 40 is positioned. Alternately, the base sheet 11 may comprise snaps, hook and loop fastening means, ties, etc. Where snaps are used, these can be of stainless steel, brass, plastic, or the like. Other attachment means can also be used. The base sheet 11 may be canvas, netting, fabric, plastic sheet material, etc. without departing from the scope of the present invention.

As shown in FIG. 1, the base sheet 11 forming the bed portion may be made of netting of a strength sufficient to support a user thereon. The use of netting provides for passage of air through the base sheet 11, which is desirable in hot and tropical climates.

Figure 6:
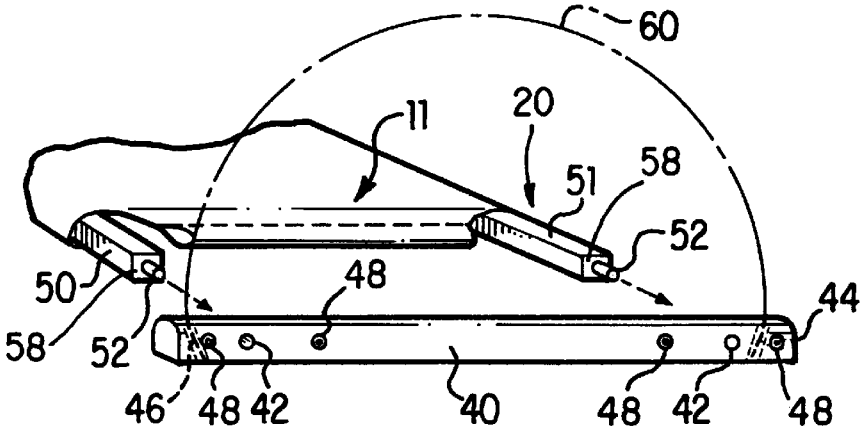
FIG. 6 is an assembly view showing the connection of side frame members to the end frame member of FIG. 3, and schematically showing connection of a rib member to the end frame member.

In FIG. 6, left and right side frame members 50 are shown in an exploded view in preparation for assembly of the connection between the first end frame member 40 and the left and right side frame member 50. The first and second side frame members 50 each preferably have shafts or pegs 52 extending from their distal ends. The shafts 52 protrude into closely received apertures 42 formed in the first or second elongated end frame member 40.

A flexible rib 60 is schematically shown in FIG. 6 in dashed outline, and is bowed into an approximately 180 degree bend when inserted into the spaced retaining apertures 46. The flexible ribs 60 may be shock corded fiberglass, tubing, rod, or other flexible material, and are about six feet long. The connection of the rib 60 in the retaining apertures 46 is described further hereunder with reference to FIG. 8.

FIG. 7 shows the assembled left and right side frame members 50 with the first elongated end frame member 40 and the legs 14. The securement of the base sheet 11 over the elongated end frame member 40 is schematically shown, and any attachment means may be used as being within the scope of the present invention.

Figure 8:
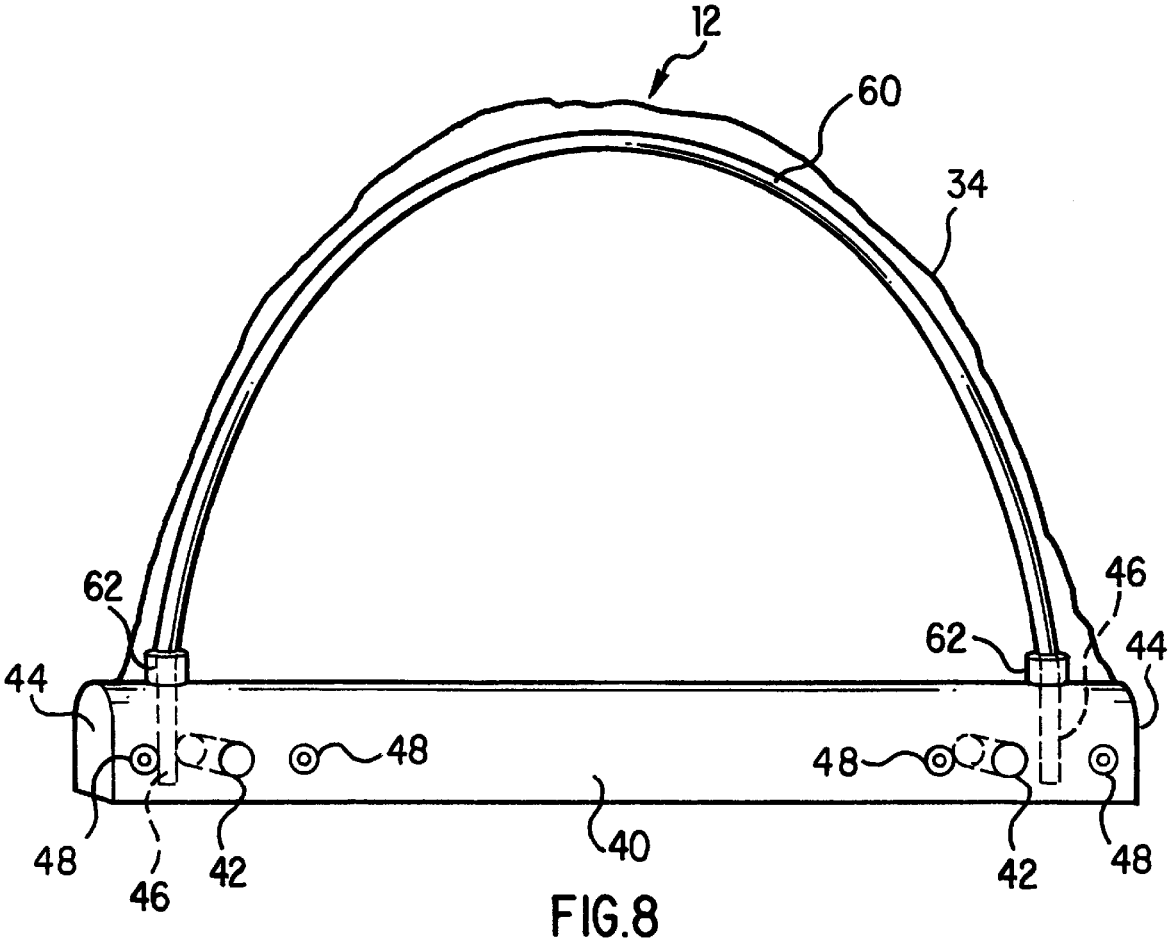
FIG. 8 is a perspective view of the rib member and stop portions as assembled with the end member of FIG. 3 through FIG. 5.

FIG. 8 is a perspective view of the flexible rib 60, showing stop portions 62, assembled in proximity to the distal ends of the flexible rib 60. The flexible rib 60 is formed as a rod or series of rods of flexible material, so that it can be stored or carried as a generally straight piece, and can be manually bent or flexed into position in the end frame member 40 when assembly is performed. The resiliency of the rib 60 serves to provide a retaining force which retains the rib 60 in position in the retaining apertures 46 in the end frame member 40. The angle of incline of the retaining apertures 46 determines the amount of force retaining the rib 60 to the end frame member 40. If the angle of the retaining apertures 46 departs significantly from the vertical, the rib 60 may be deformed from a semi-circular shape, and such deformations and other non-semicircular shapes are also contemplated as being within the scope of the present invention.

The stop portions 62 may be formed by wrapping adhesive tape around the rib 60 a plurality of times. The stop portions 62 can also be formed as rubber washer members, cylindrical sleeve members, heat shrink tubing, or the like, without departing from the scope of the present invention.

The flexible rib 60 forms a rib means, and is shown as being generally circular in cross section. However, other cross sections can also be used, such as square, hexagonal, and the like, without departing from the scope of the present invention. Also, the flexible rib 60 can be a hollow body or a solid body, without departing from the scope of the present invention.

While a first flexible rib 60 is shown in FIG. 6, a second flexible rib is disposed at the other end of the cabin cot 10. Also, the weight of the canopy 12 over the flexible ribs 60 additionally serves to keep the flexible ribs 60 connected within the respective apertures 46 in the end frame members 40 without requiring tools to releasably secure the ribs 60 to the first and second elongated end frame members 40. The elongated end frame members 40 and the ribs 60 together form a frame means for supporting the canopy 12.

As shown in FIG. 9, a suitable netting material 54, 56 may be provided to cover the space between the respective left and right side frame members 50 and the respective first and second canopy ends 15, as shown in FIG. 9. This allows air to circulate between the cot and the canopy while discouraging insects and pests from entering into the cabin cot assembly 10 beneath the canopy 12.

The invention being thus described, it will be evident that the same may be varied in many ways. Such variations are not to be regarded as a departure from the spirit and scope of the invention and all such modifications are intended to be included within the scope of the claims.

Cabin Cot

10—Cabin Cot
11—Base sheet
12—top canopy portion
13—end panels
14—legs
15—overhang portions of canopy sides
16—grommets
18—flap straps
19—flexible cover portion
20—frame means
22—bug stopper
23—cord
24—side tie straps
26—mosquito netting portion
28—end tie straps
30—tie line
32—stake
34—flexible canopy cover
40—elongated end frame member
42—spaced apertures
44—distal ends
46—rib retaining aperture
50—left and right side frame members
52—spaced apertures

54—left netting material
56—right netting material
58—distal ends of side frame members
60—flexible ribs
62—stop portions

What is claimed is:

1. A cabin cot apparatus (10), which comprises:

a) a bed frame (20) having a left side frame member (50), a right side frame member (51) and opposing first and second elongated end frame members (40, 41), said left and right side frame members (50, 51) each having a horizontal shaft portion (52) extending from opposing distal ends (58); and said first and second elongated end frame members (40, 41) each having spaced horizontal shaft apertures (42) sized to closely receive the horizontal shaft portion (52) extending from the left and right side frame members (50, 51), said first and second elongated end frame members (40, 41) extending beyond the side frame members (50, 51), the first and second elongated end frame members (40, 41) extend from three to twelve inches beyond the left and right side frame shaft apertures (42) to provide an air space between the left and right side frame members (50, 51) and the respective side portions (15) of the canopy cover (34), and the side portions (15) of the canopy cover (34) extend in spaced relation below the left and right side frame members (50, 51) a distance sufficient to cover the air space thus provided; and said bed frame (20) supported above a supporting surface by a suitable leg means (14);

b) a base sheet (11) of a strength to support a user thereon, the base sheet (11) releasably secured to the left side frame member (50), the right side frame member (51), and opposing first and second elongated end frame members (40, 41);

c) said first and second elongated end frame members (40, 41) each further having spaced vertically disposed rib apertures (46) in spaced relation from the horizontal shaft apertures (42); the first and second end frame members (40, 41) further having a plurality of releasable canopy fastening means (48) disposed thereon;

d) a first flexible rib (60) of a length greater than the first elongated end frame member (40); the first flexible rib (60) having distal ends sized to be closely received in the spaced vertically disposed rib apertures (46) in the first elongated end frame member (40), and a second flexible rib (61) of a length greater than the second elongated end frame member (41), the second flexible rib (61) having distal ends (44) sized to be closely received in the spaced, vertically disposed rib apertures (46) in the second elongated end frame member (41); the first flexible rib (60) thus forming a bowed rib extending above the first end frame member (40), and the second flexible rib (61) thus forming a bowed rib extending above the second end frame member (41);

e) a canopy (34) having a top portion (12) with sides (15) sized to extend over the first and second bowed ribs (60, 61) in spaced relation from the left and right side frame members (50, 51), a first end canopy (13*a*) extending from the top portion (12) to the first end frame member (40), and a second end canopy (13*b*) extending from the top portion (12) to the second end frame member (41), the top canopy portion (12) and first and second end canopy portions (13*a*, 13*b*) releasably secured about respective side frame members (50, 51) and end frame members (40, 41) with a suitable releasable fastening means.

2. The cabin cot apparatus (10) of claim 1, wherein a portion of the flexible canopy cover (34) is at least partially made of a suitable musquito netting material (26), and the flexible canopy cover (34) is sized to cover the musquito netting material (26) when rolled down, and wherein the flexible canopy cover (34) may be rolled up and secured with flap straps (18) to selectively expose the musquito netting material (26) for improved ventilation.

3. The cabin cot apparatus (10) of claim 1, wherein a window portion (36) made of musquito netting (26) is provided in at least one of the first and second canopy end portions (13*a*, 13*b*), and a canopy cover (34) is sized to cover the window portion (36), and wherein a portion of the flexible canopy cover (34) may be rolled up and secured with tie straps (18) to selectively expose the musquito netting material (26) for improved ventilation.

4. The cabin cot apparatus (10) of claim 3, wherein a flexible cover portion (19) is positioned over the window portion (36) to cover the window portion (36) when rolled down, and wherein the flexible cover portion (19) may be rolled up above the window portion (36) and secured with suitable tie straps (18).

5. The cabin cot apparatus (10) of claim 1, wherein a cord (23) is sewn into the hem portion of each of the canopy sides (15) and end portions (13), and wherein the cord (23) extends beyond the canopy sides (15) and end portions (13), to provide a means to tie the canopy sides (15) and end portions (13) beneath the corners of the end frame members (40, 41).

6. The cabin cot apparatus (10) of claim 1, wherein the base sheet (11) comprises musquito netting of a strength suitable to support an adult human user thereon.

7. The cabin cot apparatus (10) of claim 1, wherein a plurality of end tie straps (28) are provided in spaced relation to the first and second end canopy panels (13) adjacent to the canopy cover (34), to provide a means to secure the cabin cot assembly (10) with suitable tie line (30) to one or more remote supports.

8. The cabin cot apparatus (10) of claim 1, wherein overhang portions (15) of the canopy cover (34) extend six to eight inches below the bed frame (20), and a plurality of grommets (16) are provided in spaced relation along the overhang portions (15) of the canopy cover (34).

9. The cabin cot apparatus (10) of claim 1, wherein bug stoppers (22) are provided about each of the cabin cot legs (14).

10. It The cabin cot apparatus (10) of claim 1, wherein stop portions (62) are provided near the distal ends of the flexible ribs (60, 61) to limit penetration of the flexible ribs (60, 61) into the rib retaining apertures (46) located in said first and second elongated end frame members (40, 41).

11. The cabin cot apparatus (10) of claim 1, wherein the rib retaining apertures (46) extend only partially into the respective first and second elongated end frame members (40, 41).

12. The cabin cot apparatus (10) of claim 1, wherein the rib retaining apertures (46) are inclined up to 15 degrees from vertical alignment to provide additional tension when the distal ends of the flexible ribs (60, 61) are inserted into the rib retaining apertures (46) located in the first and second end frame members (40, 41).

13. A cabin cot apparatus (10), which comprises:

a) a bed frame {20) having a left side frame member (50), a right side frame member (51) and opposing first and second elongated end frame members (40, 41) extending beyond said left and right side members (50, 51), the first and second elongated end frame members (40,

41) extend from three to twelve inches beyond the left and right side frame shaft apertures (42) to provide an air space between the left and right side frame members (50, 51) and the respective side portions (15) of the canopy cover (34), and wherein the side portions (15) of the canopy cover (34) extend in spaced relation below the left and right side frame members (50, 51) a distance sufficient to cover the air space thus provided; said bed frame (20) secured together with a suitable fastening means; the bed frame (20) supported above a supporting surface by suitable legs (14);

b) a base sheet (11) made of netting material (26) of a strength to support a user thereon, the base sheet (11) releasably secured to the left side frame member (50), the right side frame member (51), and opposing first and second end frame members (40, 41);

c) the first and second elongated end frame members (40, 41) each having a horizontal left bed rail aperture (42) and a horizontal right bed rail aperture (42) extending in spaced relation therethrough; the first and second elongated end frame members (40, 41) also having substantially vertically disposed rib apertures (46) extending in spaced relation beyond the horizontal left and right side bed rail apertures (42); the first and second elongated end frame members (40, 41) further having a plurality of releasable fastening means (48) disposed thereon;

d) a first flexible rib (60) of a length greater than the first elongated end frame member (40); the first flexible rib (60) having distal ends sized to be closely received in the vertically disposed rib apertures (46) in the first elongated end frame member (40), and a second flexible rib (61) of a length greater than the second elongated end frame member (41), the second flexible rib (61) having distal ends sized to be closely received in the rib apertures (46) in the second elongated end frame member (41); the first flexible rib (60) thus forming a bowed rib extending above the first elongated end frame member (40), and the second flexible rib (61) thus forming a bowed rib extending above the second elongated end frame member (41), the first and second bowed ribs (60, 61) extending in spaced relation beyond the left and right side frame members (50, 51);

e) a canopy cover (34) having a top canopy portion (12) with canopy sides (15) sized to extend over the first and second bowed ribs (60, 61), a first canopy end (13*a*) extending from the top canopy portion (12) in spaced relation below the first end frame member (40) to provide a space between the left side frame member (50) and the canopy side (15), and a second canopy end (13*b*) extending from the top canopy portion in spaced relation below the second end frame member (41) to provide a space between the right side frame member (51) and the canopy side (15), the top canopy portion (12) and first and second end portions (13*a*, 13*b*) of said canopy cover (34) releasably secured to respective first and second elongated end frame members (40, 41) with a suitable releasable fastening means; at least one of the first and second canopy end portions (13*a*, 13*b*) each having an enlarged aperture covered with musquito netting (26), with a flexible cover (19) sized to cover the musquito netting (26) when the flexible cover (19) is lowered, and wherein tie straps (18) are provided to secure the flexible cover (19) above the musquito netting (26) when the flexible cover (19) is rolled into a raised position.

14. The cabin cot apparatus (10) of claim 13, wherein a cord (23) is sewn into a hem portion of each of the canopy sides and end portions (15), and wherein the cord (23) extends beyond the canopy sides and end portions (15), to provide a means to tie the canopy sides and end portions (15) beneath the corners of the elongated end frame member(s) (40, 41).

15. The cabin cot apparatus (10) of claim 13, wherein tie straps (18) are provided in spaced relation along the first and second canopy end portions (13*a*, 13*b*) adjacent to the top canopy (12), to provide a means to secure the cabin cot assembly (10) with suitable cord (30) to one or more remote supports.

16. The cabin cot apparatus (10) of claim 13, wherein bug stoppers (22) are provided about each of the cabin cot legs (14).

17. The cabin cot apparatus (10) of claim 13, wherein stop portions (62) are provided near the distal ends of the flexible ribs (60, 61) to limit penetration of the flexible ribs (60, 61) into respective rib apertures (46).

18. The cabin cot apparatus (10) of claim 13, wherein the rib apertures (46) extend only partially into the respective first and second elongated end supports (40, 41) to limit penetration of the distal ends of the flexible ribs (60, 61).

19. The cabin cot apparatus (10) of claim 13, wherein the rib apertures (46) are inclined up to 15 degrees from vertical alignment to provide additional tension when the distal ends of the flexible ribs (60, 61) are inserted into the rib apertures (46).

20. A cabin cot apparatus (10), which comprises:

a) a bed frame (20) having a left side frame member (50), a right side frame member (51) and opposing first and second elongated end frame members (40, 41) extending beyond said left and right side frame members (50, 51) the first and second elongated end frame members (40, 41) extend from three to twelve inches beyond the left and right side frame shaft apertures (42) to provide an air space between the left and right side frame members (50, 51) and the respective side portions (15) of the canopy cover (34), and wherein the side portions (15) of the canopy cover (34) extend in spaced relation below the left and right side frame members (50, 51) a distance sufficient to cover the air space thus provided;, said bed frame (20) secured together with a suitable fastening means; the bed frame (20) supported above a supporting surface by suitable legs (14);

d) a base sheet (11) made of netting material (26) of a strength to support a user thereon, the base sheet (11) releasably secured to the left side frame member (50), the right side frame member (51), and opposing first and second end frame members (40, 41);

e) the first and second elongated end frame members (40,41) each having a horizontal left bed rail aperture (42) and a horizontal right bed rail aperture (42) extending in spaced relation therethrough; the first and second elongated end frame members (40, 41) also having substantially vertically disposed rib apertures (46) extending in spaced relation beyond the horizontal left and right side bed rail apertures (42); the first and second elongated end frame members (40, 41) further having a plurality of releasable fastening means (48) disposed thereon;

d) a first flexible rib (60) of a length greater than the first elongated end frame member (40); the first flexible rib (60) having distal ends sized to be closely received in the vertically disposed rib apertures (46) in the first elongated end frame member (40), and a second flexible rib (61) of a length greater than the second elongated end frame member (41), the second flexible rib (61) having distal ends sized to be closely received in the rib apertures (46) in the second elongated end frame member (41); the first flexible rib (60) thus forming a bowed rib extending above the first elongated end frame member (40), and the second flexible rib (61) thus forming a bowed rib extending above the second elongated end frame member (41), the first and second bowed ribs (60, 61) extending in spaced relation beyond the left and right side frame members (50, 51);

e) a canopy cover (34) having a top canopy portion (12) with canopy sides (15) sized to extend over the first and second bowed ribs (60, 61), a first canopy end (13*a*) extending from the top canopy portion (12) in spaced relation below the first end frame member (40) to provide a space between the left side frame member (50) and the canopy side (15), and a second canopy end (13*b*) extending from the top canopy portion in spaced relation below the second end frame member (41) to provide a space between the right side frame member (51) and the canopy side (15), the top canopy portion (12) and first and second end portions (13*a*, 13*b*) of said canopy cover (34) releasably secured to respective first and second elongated end frame members (40, 41) with a suitable releasable fastening means; at least one of the first and second canopy end portions (13*a*, 13*b*) each having an enlarged aperture covered with musquito netting (26), with a flexible cover (19) sized to cover the musquito netting (26) when the flexible cover (19) is lowered, and wherein tie straps (18) are provided to secure the flexible cover (19) above the musquito netting (26) when the flexible cover (19) is rolled into a raised position.

* * * * *